US006505380B1

(12) United States Patent
Bourgeois

(10) Patent No.: US 6,505,380 B1
(45) Date of Patent: Jan. 14, 2003

(54) DEVICE FOR HANGING A CURTAIN UNDERNEATH A RAIL

(75) Inventor: Michel Bourgeois, Paris (FR)

(73) Assignee: Madura, Paris (FR)

( * ) Notice: Subject to any disclaimer, the term of this patent is extended or adjusted under 35 U.S.C. 154(b) by 0 days.

(21) Appl. No.: 09/890,481

(22) PCT Filed: Nov. 27, 2000

(86) PCT No.: PCT/FR00/03308

§ 371 (c)(1),
(2), (4) Date: Oct. 11, 2001

(87) PCT Pub. No.: WO01/39639

PCT Pub. Date: Jun. 7, 2001

(30) Foreign Application Priority Data

Nov. 30, 1999 (FR) ..... 99 15089

(51) Int. Cl.[7] ..... E05D 15/00
(52) U.S. Cl. ..... 16/87.2; 16/87 R
(58) Field of Search ..... 16/87.2, 87 R; 24/104, 113 R, 488, 581.1, 598.2, 716; 160/330, 368.1

(56) References Cited

U.S. PATENT DOCUMENTS

| | | | | | |
|---|---|---|---|---|---|
| 2,302,341 | A | * | 11/1942 | Nash | 16/87.2 |
| 2,320,003 | A | | 5/1943 | Madan | |
| 2,805,457 | A | * | 9/1957 | Vaca | 16/87.2 |
| 5,339,884 | A | * | 8/1994 | Angerman | 16/87.2 |
| 5,586,375 | A | * | 12/1996 | Cooperman et al. | 16/87.2 |

FOREIGN PATENT DOCUMENTS

| | | |
|---|---|---|
| DE | 12 83 451 | 11/1968 |
| GB | 1143552 | 2/1969 |

* cited by examiner

*Primary Examiner*—Chuck Y. Mah
(74) *Attorney, Agent, or Firm*—Christie, Parker & Hale, LLP

(57) ABSTRACT

A device for hanging a curtain is provided. The device has a hook portion, a threaded rod portion extending from the hook portion and two cups screwed on the threaded rod portion. The threaded rod portion is passed through the curtain and the curtain is clamped by the two cups. The hook portion may then be supported on a suspended rail for hanging the curtain.

7 Claims, 1 Drawing Sheet

DEVICE FOR HANGING A CURTAIN UNDERNEATH A RAIL

CROSS-REFERENCE TO RELATED APPLICATION

This application claims priority of International application number PCT/FR00/03308, filed Nov. 27, 2000, which in turn claims priority to French patent application number 99/15089, filed Nov. 30, 1999.

BACKGROUND OF THE INVENTION

The invention concerns a device for fixing the side of a curtain to a bar or rod extending from the said side, this device consisting of a elongated part with a first area of its extremity shaped so as to straddle the rod by resting on it towards the said side and with a second area of its extremity, opposite the first, made to cross the said side in its thickness.

The term "curtain" here refers to any object with an extended area and a relatively shallow thickness, flexible or rigid, such as a piece of cloth woven or not, a sheet, a plate or a cover of any kind.

Such devices are used in particular to suspend curtains, such as window or shower curtains. In their simplest version, the two areas of the extremities of the elongated part are shaped into hooks, and the side of a hole arranged in the curtain for the passage of the hook of the second area of the extremity to rest thereon. Such devices are unsightly, Moreover, the hole has to be fitted with an eyelet in order to prevent the hook from tearing the curtain.

The purpose of the invention is to overcome these difficulties, ensuring simple structures and handling for the hanging devices.

The invention in particular contemplates a device of the kind described in the introduction, and provides that the said secondary area of the extremity is in the shape of a threaded rod and that the device in addition includes two cups pierced in their centre for the axial passage of the threaded rod, at least the first of the said cup disks capable of being screwed onto the threaded rod and a clamping system to grip the second cup when the first cup is screwed on to it so as enable the curtain to be sandwiched between the two cups in an area at least partially surrounding the rod.

Optional features of the invention, complementary or alternative, are described below:

The second cup can also be screwed onto the threaded rod, the said means of retention consisting of the secondary threads of the second cup and of the rod. The cups can clamp the curtain between them in a circular area entirely surrounding the rod.

The cups and the said circular area have appreciable ways of turning around the pivot of the rod.

The facing surfaces of the two cups present recesses for attaching an eyelet fitted to the curtain and whose central aperture is traversed by the threaded rod.

BRIEF DESCRIPTION OF THE DRAWINGS

The features and advantages of the invention will be set out more fully in the description below, with reference to the annexed drawings.

DETAILED DESCRIPTION OF THE INVENTION

The device illustrated includes an elongated element 1 in the form of a metal rod with a circular section. Rod 1 is arranged in the general shape of an S, its upper extremity area 2 consisting of a hook able to straddle Rod 3 and rest on it vertically, and its lower extremity area 4, quite straight and horizontal, being threaded.

Figure 1:
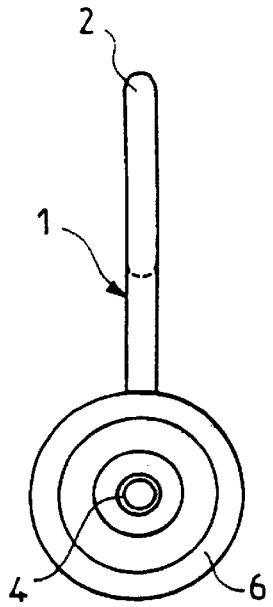
FIG. 1 is a front view of a device in accordance with the invention.
Figure 2:
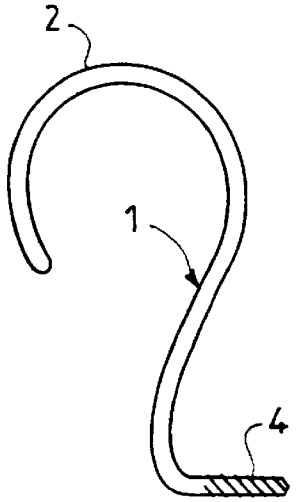
FIG. 2 is a side-view of the elongated part.
Figure 3:
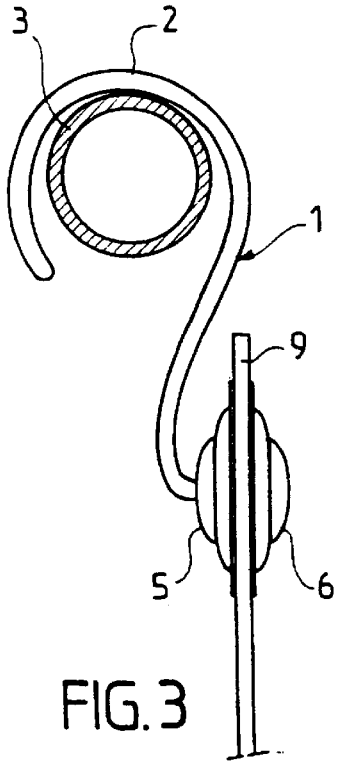
FIG. 3 is a side-view of the device fitted to a curtain and hung on a rod.
Figure 4:
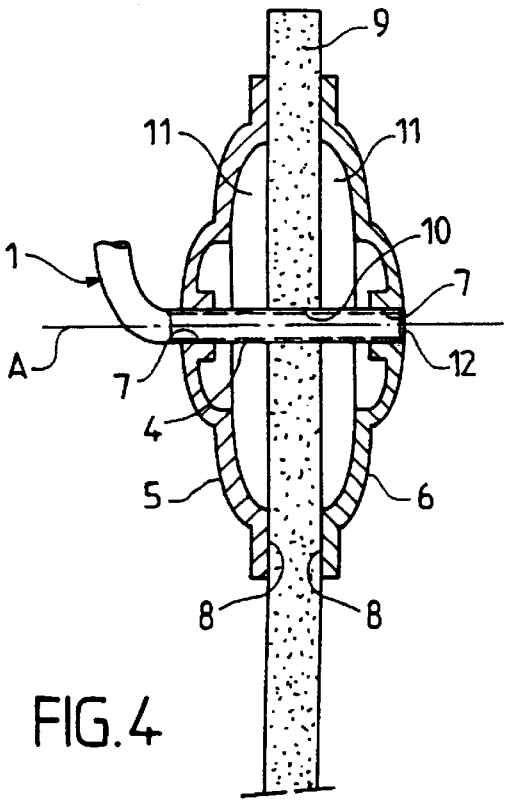
FIG. 4 is a partial cut-out view of the device fitted to a curtain.
Figure 5:
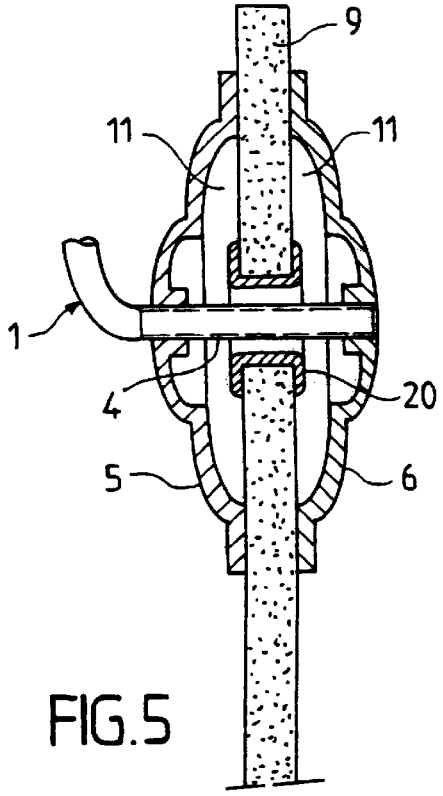
FIG. 5 is a view similar to FIG. 4, the curtain being fitted with an eyelet.

Two identical cups 5, 6, having a convex shape for turning around horizontal axis A, each having an axially traversed hole 7 fitted with a thread matching the thread of the part 4 of Rod 1. The two cups can thus be screwed onto Part 4, with their concavities turned towards each other, as shown in FIGS. 3 to 5. The peripheral edge of each cup presents an annular surface 8 situated on a plane perpendicular to Axis A of Rod Part 4 and to the cups. The surfaces 8 may act as support on one side and the other of the upper side 9 of a curtain, also threaded onto Rod Part 4 through a pierced hole 10 already made with the help of an awl.

By screwing the two cups towards each other, the curtain can be tightened between their respective supporting surfaces 8, thus providing firm support for the curtain without the risk of tearing around the hole 10.

Although the method of installation of the device according to the invention on the curtain makes an eyelet superfluous, FIG. 5 shows that the device can also be used with a curtain already fitted with an eyelet 20, whose sides are fitted into the existing cavities 11 between the surfaces of the curtain and the internal surfaces of the cups, due to their concave shape.

The thread of the two cups enables the bottom of the cup 6 to be aligned with the free extremity 12 of the threaded rod Part 4, preventing it from protruding out of the cup and thus further improving the appearance of the device. It is nevertheless possible to arrange, as a variation, for only one of the cups, in particular the outside cup 6, to be threaded while the other cup slides freely on the rod 2, such as on a horizontal smooth part prolonging the threaded part 4, as far as a stop, formed for example from a flange or a shoulder of the rod. The interior cup may also be secured to the rod, by force fit for example, or crimping, welding or gluing. The free extremity of the rod may protrude or not from the bottom of the cup 6, depending upon the thickness of the curtain. It is possible to arrange a trim screwed onto the prominent part of the rod to conceal it. Where there are two threaded cups, the outside cup, instead of being identical to the inside cup, may present a threaded blind hole, the bottom of which rests on the free end of the rod.

According to another variant not represented, the hook 2 can be replaced by a closed loop to be threaded onto the extremity of the rod.

The elongated element and the cups constituting the device in accordance with the invention may be made, separately from each other, from any suitable material.

The device in accordance with the invention may be used not only to hang a curtain, but to fix to a bar or rod any flexible material, such as wall coverings or awnings, and the material does not need to be suspended vertically but can be spread in any direction, being tensed by forces applied to points away from the area where the device is installed. The curtain may also be rigid, such as in the form of a panel hung from a bar or rod.

I claim:

1. A securing device for coupling one side of a curtain to a bar or rod, the device comprising:

an elongated part having a first portion shaped so as to straddle the rod by resting on it and a second threaded rod portion extending from the first portion;

two cups separate from said elongate part for sandwiching the curtain, said cups penetrated by the threaded rod, portion wherein at least a first of said cups is screwed onto the threaded rod portion; and means for retaining a second of said cups when the first cup is screwed on said threaded rod portion.

2. A device in accordance with claim 1 said means of retaining comprising threads for threading the second cup on said threaded rod portion.

3. A device in accordance with claim 1 or claim 2, in which the cups can tighten the curtain between them in a circular area entirely surrounding the threaded rod portion.

4. A device in accordance with claim 3, in which the cups can rotate relative to the rod portion.

5. A device in accordance with claim 1, wherein facing surfaces of the two cups define recesses for attaching an eyelet coupled to the curtain and wherein the eylet is traversed by the threaded rod portion.

6. A device in accordance with claim 1, in which the elongated part is in the form of a rod with a circular section.

7. A device in accordance with claim 1, in which the two cups are identical.

* * * * *